US007471255B2

(12) United States Patent
Welch

(10) Patent No.: US 7,471,255 B2
(45) Date of Patent: Dec. 30, 2008

(54) ANTENNA WITH REDUCED INTERFERENCE

(75) Inventor: William J. Welch, Berkeley, CA (US)

(73) Assignee: The Regents of the University of California, Oakland, CA (US)

( * ) Notice: Subject to any disclaimer, the term of this patent is extended or adjusted under 35 U.S.C. 154(b) by 206 days.

(21) Appl. No.: 11/472,800

(22) Filed: Jun. 22, 2006

(65) Prior Publication Data

US 2006/0290585 A1 Dec. 28, 2006

Related U.S. Application Data

(60) Provisional application No. 60/693,233, filed on Jun. 23, 2005.

(51) Int. Cl.
*H01Q 13/00* (2006.01)
*H01Q 15/14* (2006.01)

(52) U.S. Cl. ..... 343/781 CA; 343/781 P; 343/912

(58) Field of Classification Search ..... 343/781 P, 343/781 CA, 781 R, 785, 786, 912
See application file for complete search history.

(56) References Cited

U.S. PATENT DOCUMENTS 5,426,443 A * 6/1995 Jenness, Jr. ..... 343/781 P
5,793,334 A * 8/1998 Anderson et al. ..... 343/786

OTHER PUBLICATIONS

D. DeBoer et al, "The Allen Telescope Array", vol. 5489—Ground-based Telescopes, J.M. Oschmann, Jr. Ed., Proceedings of SPIE Europe: Astronomical Telescopes and Instrumentation, and (to the best of applicant's recollection) first available to conference participants on Jun. 21, 2004.

D. DeBoer, "The Allen Telescope Array", as presented in vol. 5489, Session 14 of Proceedings of SPIE Europe: Astronomical Telescopes and Instrumentation, Glasgow, Scotland, UK, presentation materials displayed to attendees from 14:00 to 15:50, Friday, Jun. 25, 2004.

Technical Program vol. 5489: "Ground-based Telescopes", excerpted from Technical Programme of Astronomical Telescopes and Instrumentation, Jun. 21-25, 2004, Glasgow, Scotland, UK, Sponsored by SPIE Europe.

G. Cortes-Medellin, et al, "Noise Contribution Analysis for the Arecibo Gregorian Radio Telescope", Proceedings of the 1999 Antenna Applications Symposium, Sep. 15-17, 1999, downloaded from: http://www.ecs.umass.edu/ecu/allerton/papers1999/cover.html on Jun. 16, 2006, 13 pgs.

* cited by examiner

*Primary Examiner*—Shih-Chao Chen
(74) *Attorney, Agent, or Firm*—Michaelson & Associates; Peter L. Michaelson; George Wolken, Jr.

(57) ABSTRACT

The present invention relates generally to the field of reflector-type antennas based on the offset Gregorian design having a substantially paraboloidal-shaped primary reflector and a substantially ellipsoidal secondary reflector displaced from the optical axis of the primary reflector. The first focus of the secondary reflector is substantially coincident with the focus of the primary reflector and a feed or detector is placed substantially at the second focus of the secondary reflector. A partially open shroud placed between the primary reflector and the secondary reflector is shown to result in reduced ground interference and improved antenna efficiency and sensitivity.

4 Claims, 1 Drawing Sheet

ANTENNA WITH REDUCED INTERFERENCE

CROSS-REFERENCE TO RELATED APPLICATION

This application claims priority under 35 U.S.C § 119(e) to the following U.S. provisional application Ser. No. 60/693,233 filed Jun. 23, 2005 which is incorporated herein by reference in its entirety for all purposes.

BACKGROUND OF INVENTION

1. Field of Invention

This invention relates generally to the field of reflector-type antennas and, more specifically, to reflector-type antennas based on the offset Gregorian configuration.

2. Description of Prior Art

Financial support from the SETI Institute, made possible by the Paul G. Allen Foundation, is gratefully acknowledged.

The present invention relates to reflector-type antennas and antenna systems based on the offset Gregorian design. Reflector antennas are described in several references including, for example, "Reflector Antennas" by K. S. Kelleher and G. Hyde appearing as Chapter 17 of the "Antenna Engineering Handbook," 3rd Ed., Richard C. Johnson Ed. (McGraw-Hill, 1993), the entire contents of which is incorporated herein by reference for all purposes.

The Gregorian design was first used as an optical reflecting telescope and named after its inventor, James Gregory, who described it in 1663. The optical Gregorian telescope comprises a parabolic primary reflector serving as the objective, and a concave, elliptical secondary reflector located on the optical axis beyond the primary focal point. The image is formed behind the primary parabolic reflector through which a hole has been bored.

The basic Gregorian structure as used in optical telescopes may be adapted for use as an antenna operating with wavelengths longer than the optical region of the spectrum, typically as a radio telescope operating in the region of microwave or radio frequencies. Typically, a configuration known as an offset Gregorian design may be implemented wherein the secondary reflector is positioned off the primary axis. This structure has many benefits such as improved beam efficiency, greater effective area, and lower sidelobe levels. However, feed spillover onto the ground from this design may carry a potential for increased background noise, leading to lowered sensitivity and increased signal collection times. This is a particularly important characteristic for applications in radio astronomy in which the goal is typically to detect, collect, and analyze faint signals emanating from the sky.

The reciprocity theorem for antennas is a well-known and often-used theorem showing that the performance of an antenna is the same whether it is used in reception or transmission, provided however, that no non-reciprocal devices (such as diodes) are present. For the typical cases considered herein, the reciprocity theorem applies and we describe the performance of antennas either in transmission or reception without distinction. That is, when used for transmission, electromagnetic energy is delivered to the antenna for transmission by means of a "feed." When used in reception, energy collected by the antenna is delivered to a "detector" for detection and delivery to various electronic or other signal processing means. In the descriptions herein, the reciprocity theorem is employed and feeds or detectors are described as components of the antenna or antenna system without distinction, unless specifically noted.

Therefore, in light of the above description, a need exists in the art for systems and methods to maintain the benefits of the offset Gregorian antenna design while reducing background noise and ground scatter. Addressing this need would result in an antenna with improved performance and, for a particular application example, a radio telescope with improved sensitivity and improved signal collection efficiency.

SUMMARY OF THE INVENTION

Accordingly and advantageously the present invention relates to systems and methods that provide for one or more shrouds around, or partially surrounding, the secondary reflector of an offset Gregorian antenna. Such shroud or shrouds may serve to block or reduce one or more of ground thermal radiation, interference incident upon the antenna from along the ground, and scattered radiation from the ground caused by spillover from the collected beam. Thereby background noise is reduced and antenna performance improved.

These and other advantages are achieved in accordance with the present invention as described in detail below.

BRIEF DESCRIPTION OF THE DRAWINGS

To facilitate understanding, identical reference numerals have been used, where possible, to designate identical elements that are common to the figures. The drawings are not to scale and the relative dimensions of various elements in the drawings are depicted schematically and not to scale.

The techniques of the present invention can readily be understood by considering the following detailed description in conjunction with the accompanying drawings, in which.

DETAILED DESCRIPTION OF THE INVENTION

Figure 1:
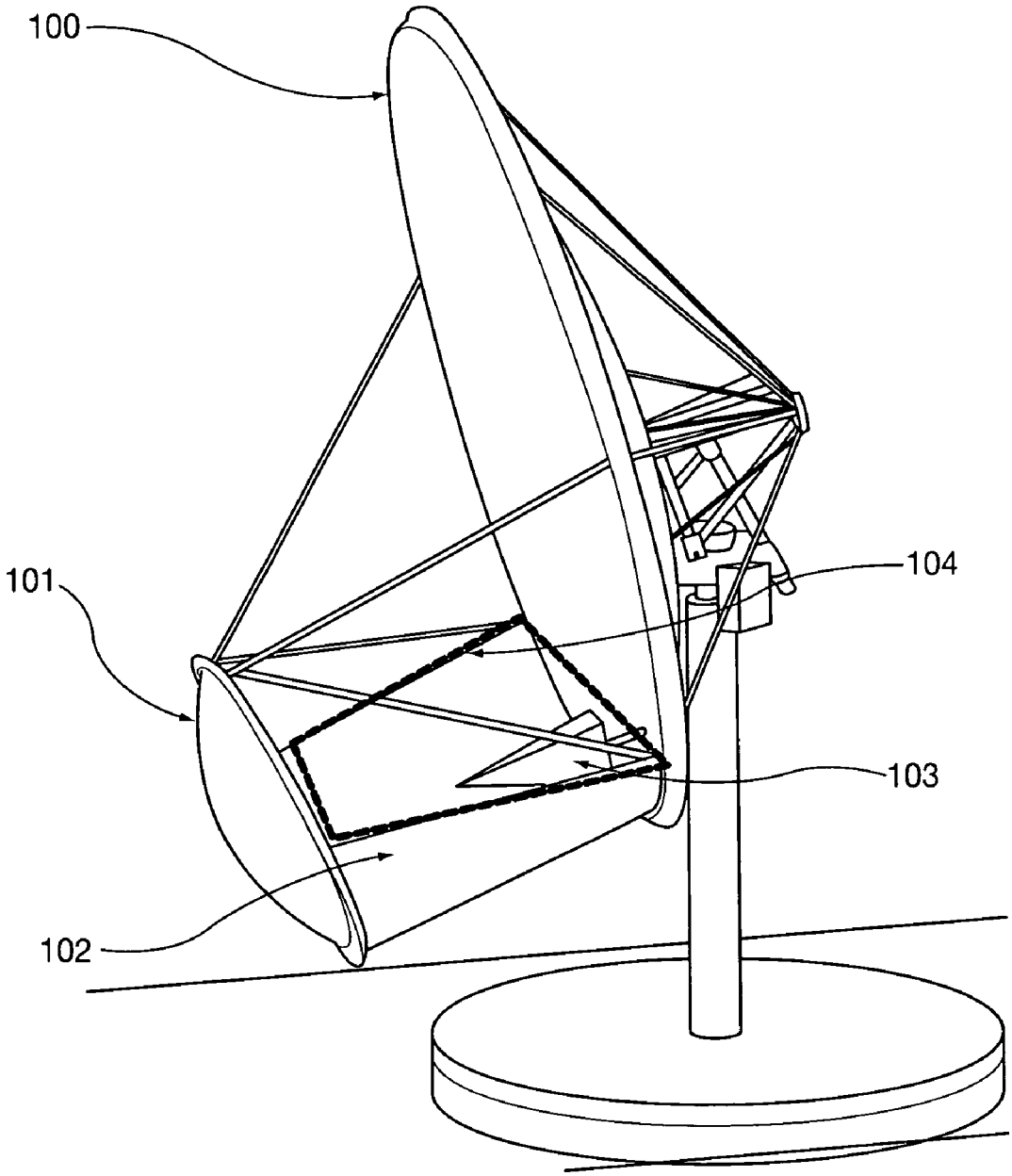
FIG. 1 is a schematic depiction of an antenna system pertaining to some embodiments of the present invention.

After considering the following description, those skilled in the art will clearly realize that the teachings of the invention can be readily utilized in offset Gregorian antennas, for example, as used in radio astronomy or other applications.

The present invention relates to a reflector-type antenna based on the classical optical Gregorian telescope design. The primary and secondary reflectors are offset from the optical axis so that the entrance window is a clear aperture. Some embodiments of the present invention include one or more partially open, typically half-cylindrical or partially cylindrical electrically conducting shrouds (typically metal) lying between the primary and secondary reflectors, and which partially surround the feed (or detector, hereinafter simply "feed" pursuant to the usage and limitations discussed above.). This shroud, which is approximately a half-cylinder pursuant to some embodiments, typically lies on the side of the reflectors opposite to the optical axis of the primary. This is typically the side closest to the ground and, thus, the shroud provides a level of protection of the feed from ground thermal radiation, interference incident upon the antenna from along the ground, and scattered radiation from the ground caused by spillover from the collected beam. This antenna configuration and structure provide a receiving system with reduced thermal background noise, reduced radio frequency interference, among other advantages. The top of the shroud may be covered by a covering, advantageously transparent or substantially transparent in the frequency range of operation for the antenna. Various types of plastic can be substantially transparent at the radio frequencies typically of interest in the operation of such antennas, and thus may provide a total or near-total environmental cover for the detector (or feed).

The antennas described herein pursuant to some embodiments of the present invention use the design of a classical offset Gregorian system, an exemplary embodiment is shown in FIG. 1. In some embodiments of the present invention, the antenna consists of a large primary reflector, 100, having substantially a paraboloidal shape, and a smaller secondary reflector, 101, having substantially the shape of an ellipsoid. The ellipsoidal reflector is placed in front of the paraboloidal reflector with one of its foci substantially coincident with that of the focus of the paraboloid and the other ellipsoid focus near the vertex of the paraboloid. With this arrangement, distant rays that are substantially parallel to the optical axis strike first the primary reflector and then the secondary reflector, and are finally focused at the second focal point of the ellipsoid near the vertex. In the offset case, neither the primary nor the secondary need to be symmetric relative to the optical axis, and only the corresponding portion of the secondary needed to catch the partial primary rays can be kept. The region of the Gregorian focus may then be free of all but the rays coming to it from the secondary, and a feed, 103, (or detector) placed at that focus will not substantially block the rays. Thus, the effective entrance window is substantially free of obstruction of the rays by either the secondary reflector or a detector located at the focus.

Some embodiments of the present invention include, in addition to this offset arrangement, a cylindrical metal (or other conducting) shroud, 102, that partially surrounds the feed (or detector) at the Gregorian focus, an example of which is depicted in FIG 1. This shroud intercepts a very small amount of electromagnetic energy (or rays) incident on the primary along the optical axis or any of the rays reaching the feed from the secondary. The shroud is typically located on the side of the optical axis toward the ground as depicted in FIG. 1. With the antenna system functioning as a transmitter, radiation in the sidelobes of the feed that is emitted toward the ground is reflected up toward the sky either directly or by reflection from the primary or secondary. This reflected radiation contributes to the overall sidelobes of the system toward the sky. With the system operating as a receiver, it now effectively receives radiation only from the sky and not from the ground. The top of the shroud may be covered by a radio transparent plastic covering (or other material transparent to the electromagnetic radiation of interest), 104 (indicated by dashed lines), and will thus provide protection for the feed from the environment.

Both numerical simulations of antenna performance and experimental data show that if the feed is located at the Gregorian focus, less than about one percent of the ground radiation is received for any orientation of the antenna. The advantages in antenna performance offered by the structures and configurations described herein include improved sensitivity and improved protection from unwanted radio interference arriving from substantially any direction. Conventional antenna and radio telescope systems typically receive about 5-10 percent of the ground brightness radiation. Theoretical considerations of antenna performance show that the effect of the presence of the shroud on the input reflection coefficient of the feed is to add a term which has the magnitude given by Eq. 1.

$$|s_{11}|=[G(90)^2/10][\lambda/a] \qquad \text{Eq1}$$

Where G(90) is the gain of the feed at 90 degrees from its axis, $\lambda$ is the wavelength, and "a" is the radius of the cylinder. For example, if G(90) =0.035 (−14.5 db), and a =2$\lambda$(which are typical values), then $s_{11}=6\times10^{-5}$, which is a small quantity.

Where G (90) is the gain of the feed at 90 degrees from its axis, $\lambda$ is the wavelength, and "a" is the radius of the cylinder. For example, if G(90) =0.035 (−14.5 db) and a =2$\lambda$ (which are typical values), then $s_{11}=6\times10^{-5}$, which is a small quantity.

Although various embodiments which incorporate the teachings of the present invention have been shown and described in detail herein, those skilled in the art can readily devise many other varied embodiments that still incorporate these teachings.

What is claimed is:

1. An offset Gregorian antenna comprising:

a primary reflector having a substantially paraboloidal shape; and, a secondary reflector having substantially an ellipsoidal shape, displaced from the optical axis of said primary reflector, wherein the first focus of said secondary reflector is substantially coincident with the focus of said primary reflector; and, a feed or detector located substantially coincident with the second focus of said secondary reflector; and, a conducting shroud partially surrounding said feed or detector, wherein said shroud is located between said feed or detector and a ground while providing substantially unimpeded passage of radiation between said feed or detector and said primary reflector and said secondary reflector.

2. An antenna as in claim 1 wherein said conducting shroud has a substantially half-cylindrical shape.

3. An antenna is in claim 1 further comprising:

a material covering the open region of said conducting shroud, wherein said material is substantially transparent at the frequency range of operation for said antenna.

4. A antenna as in claim 1 wherein said conducting shroud extends from substantially the surface of said primary reflector to the surface of said secondary reflector.

* * * * *